US005389327A

United States Patent [19]

Longhi

[11] Patent Number: 5,389,327

[45] Date of Patent: * Feb. 14, 1995

[54] POLYAMIDE PIGMENT DISPERSION

[75] Inventor: Raymond Longhi, Seaford, Del.

[73] Assignee: E. I. Du Pont de Nemours and Company, Wilmington, Del.

[ * ] Notice: The portion of the term of this patent subsequent to Jun. 29, 2010 has been disclaimed.

[21] Appl. No.: 45,293

[22] Filed: Apr. 13, 1993

[51] Int. Cl.[6] ..... D01D 5/12; D01F 1/02; B29C 41/22; C08L 51/00

[52] U.S. Cl. ..... 264/210.8; 264/211; 264/78; 525/432; 524/538

[58] Field of Search ..... 264/210.8, 211; 267/78; 525/432; 524/538

[56] References Cited

U.S. PATENT DOCUMENTS

| | | | |
|---|---|---|---|
| 3,900,676 | 8/1975 | Alderson | 428/372 |
| 4,001,171 | 1/1977 | Khanna | 260/40 R |
| 5,108,684 | 4/1992 | Anton et al. | 264/176.1 |
| 5,194,090 | 3/1993 | Tajiri et al. | 106/499 |
| 5,223,196 | 6/1993 | Shridharani et al. | 264/78 |

FOREIGN PATENT DOCUMENTS

| | | | |
|---|---|---|---|
| 2037603 | 9/1992 | Canada | C09D 191/06 |
| 4-281013 | 10/1992 | Japan | D01F 6/90 |
| 9208827 | 5/1992 | WIPO | D01F 6/80 |
| 9208829 | 5/1992 | WIPO | D01F 6/80 |

*Primary Examiner*—Paul R. Michl
*Assistant Examiner*—Patrick Niland

[57] ABSTRACT

An improved process for preparing pigmented drawn polyamide fibers is disclosed, the improvement being the improved processability obtained from the use of an N,N'-dialkyl polycarbonamide as a carrier polymer for the pigment dispersion.

3 Claims, 1 Drawing Sheet

POLYAMIDE PIGMENT DISPERSION

FIELD OF THE INVENTION

This invention relates to an improved process for introducing additives, especially pigments, into polyamide yarns using a liquid N,N'-dialkyl polycarbonamide as the polymer matrix for the additive dispersion.

BACKGROUND OF THE INVENTION

Nylon yarns and products made therefrom, such as fabrics and carpeting, have long been colored by treatment with acid, cationic, or other types of dyes. Recently, yarn producers have begun incorporating colored pigments into nylon yarns to improve their resistance to degrading and fading in ultraviolet light, to provide improved resistance to chemicals and noxious fumes, and to provide permanent coloration which is not removed by washing. While some pigments can be mixed easily into the nylon without adversely affecting the filament spinning operation, most pigments—and particularly organics—cause some difficulties while being mixed into the nylon or in subsequent melt-spinning and drawing operations. In general, organic pigments may cross-link nylon, change its viscosity, increase the rate of crystallization and form spherulites resulting in increased draw tension, weakened fibers, and more filament breaks.

U.S. Pat. No. 5,108,684 ("Anton et al.") discloses processes for making stain-resistant, pigmented-colored polyamide fibers with acceptable levels of spinning performance. Those processes involve forming a random nylon copolymer made with up to 4.0 weight percent of a cationic dye additive such as 5-sulfoisophthalic acid or its salts, adding a pigment dispersed in a matrix of nylon 6 and a nylon 6/66/610 multipolymer to the random copolymer, and melt-spinning the pigment-/polymer blend.

The pigment dispersions (or concentrates) used in making such fibers are typically prepared by first combining the raw pigment with the nylon multipolymer in roughly equal percentages by weight, melting and resolidifying the combination to form pigmented pellets of the multipolymer. These pellets are then remelted or "let-down" in an equal or greater amount of nylon 6, mixed thoroughly to form a uniform dispersion, resolidified, and pelletized. Polyamide fibers colored with certain pigments, however, remain very difficult to spin and draw when the pigments are dispersed in such matrices.

World Patent Publication No. 92/08829 ("Lin") discloses pigment concentrates made from a carrier polymer which is a random copolymer of hexamethylenediamine, isophthalic acid and terephthalic acid. This carrier polymer improves the spinning performance of polyamide fibers colored with many types of pigments.

Solid pigment concentrates having high melting points such as those described above are typically gravity fed to a screw melter where they are melted and mixed with fiber-forming polyamide. The resulting molten mixture is then pumped through a transfer line to a plurality of spinning positions and spun into fiber. It would be advantageous to have a pigment dispersion which is a liquid at room temperature or which melts below 100° C. (i.e. does not require expensive or complex melting and pumping equipment such as a screw melter) and which therefore could easily be added to the fiber spinning process anywhere prior to the spinneret. Addition of concentrate near the spinneret minimizes waste fiber made when transitioning between colors or other additives. It also allows for multiple different fiber products to be made from a single source of fiber-forming polyamide.

SUMMARY OF THE INVENTION

In one embodiment, the present invention provides an improved method for preparing pigmented drawn polyamide filaments. The process involves adding a liquid pigment concentrate to a molten fiber-forming polyamide, mixing well and then spinning the blend into filaments and drawing the filaments.

The pigment dispersions or concentrates of this invention are comprised of from about 1–60% by weight (based on total weight of concentrate) of pigment dispersed in a liquid or low melting (less than 100° C.) polymeric carrier of from about 40–99 weight (based on total weight of concentrate) percent of an N,N'-dialkyl polycarbonamide, preferably poly(N,N'-dibutylhexamethylene dodecamide) or poly(N,N'-diethylhexamethylene dodecamide). Poly(N,N'-dibutylhexamethylene dodecamide) is especially preferred. Much less than 1% pigment makes the concentrate ineffective at coloring fiber-forming polyamides. Increasing the pigment level much beyond 60% causes the viscosity of the concentrate to be too high to process easily. The compositions may also optionally include small quantities of lubricants and surfactants conventionally used as dispersion aids in pigment concentrates.

Besides pigments, these polymeric carriers may be used to introduce other additives such as stabilizers, luster modifiers, antimicrobial agents, etc.

The use of these pigment concentrates (vs. pigment concentrates made from other carrier polymers) results in reduced draw tension necessary to achieve a predetermined degree of draw in the pigmented fiber. Reduced draw tension means fewer filament breaks during spinning. Additional benefits include uniform dispersion of the pigment within the polymer matrix, simplified preparation of the concentrate itself, and the ability to add the pigments anywhere in the spinning process prior to the spinneret without the need for expensive or complex melting equipment such as a screw melter.

DETAILED DESCRIPTION OF THE INVENTION

Figure 1:
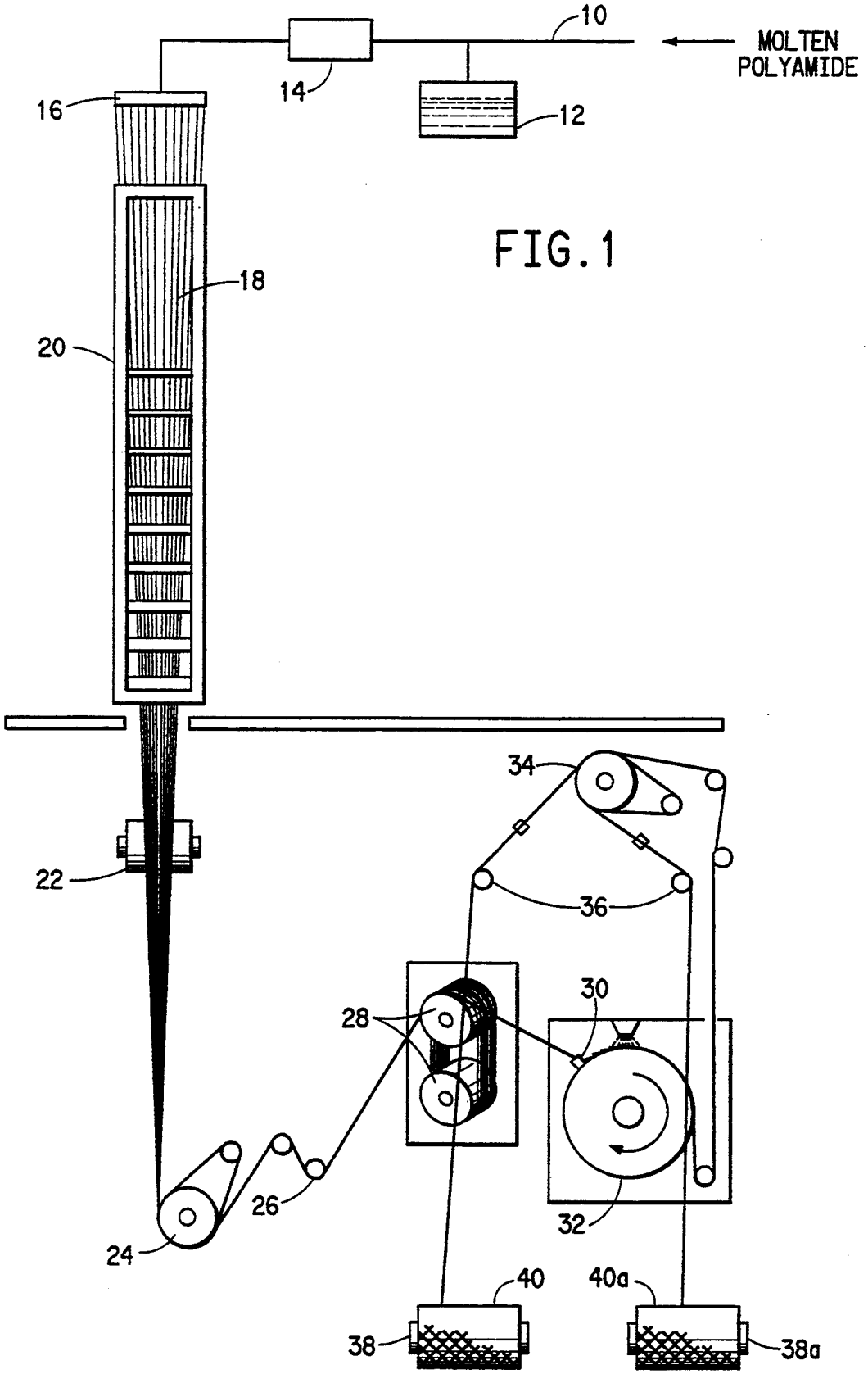
FIG. 1 is a schematic depiction of a preferred embodiment of this invention.

Referring to FIG. 1, molten fiber-forming polyamide is pumped from its source, which may be an extruder or a continuous polymerizer, through a transfer line 10 ultimately to spinneret 16. In a preferred embodiment, at some point intermediate the spinneret and the source of fiber-forming polymer, liquid pigment concentrate is pumped from a supply 12 and injected into the transfer line. Depending on the melting point of the carrier polymer used to make the pigment dispersion, supply 12 may need to be heated in order to liquify the pigment concentrate. The only limitation on where in the process the pigment concentrate is injected is that adequate mixing of concentrate and fiber-forming polyamide must take place prior to the spinneret. Injecting closer to the spinneret minimizes polymer or fiber waste when transitioning between colors or other additives and also allows for multiple different fiber products to be made from a single polymer source. Alternatively, pigment concentrate may be added to a screw melter (not shown) and mixed there with fiber-forming polymer before it is pumped through the transfer line to the spinneret. Immediately after pigment concentrate is added to fiber-forming polymer in the process, is an in-line mixer 14 which may be a dynamic mixer, a static mixer or a combination of dynamic and static mixers. The remaining steps in the process for making drawn pigmented filaments are standard spinning and drawing procedures. The mixture or blend is then spun through spinneret 16 and into a quench chimney 20 where a cooling air is blown past the hot filaments 18. The filaments are then pulled from the spinneret 16 and through the quench zone by means of a puller or feed roll 24. After quenching in air, the filaments are treated with spin-draw finish material by contacting a finish applicator 22. Next, the filaments pass around feed roll 24 from where the yarn is drawn over a pair of draw pins 26 by a pair of heated draw rolls 28. An insulated enclosure reduces loss of heat energy from draw rolls 28. The resulting yarn may be crimped and cut into staple or bulked to make BCF. For BCF, the yarn filaments are heated and advanced for bulking by a hot air jet 30 of the type described in Breen and Lauterbach, U.S. Pat. No. 3,186,155. The hot fluid exhausts with the threadlines against a rotating drum 32 having a perforated surface, on which the yarns are cooled to set the crimp using air and, optionally, a mist quench of deionized water. From the drum 32, the threadlines in bulky form pass to a driven take-up roll 34, over secondary finish applicators 36 onto rotating cores 38 and **38*a* to form packages 40 and 40*a***.

The polymeric carrier or matrix used in making the pigment concentrates of this invention is an N,N'-dialkyl polycarbonamide which melts below 100° C., making it unnecessary to use a screw melter to liquefy the pigment concentrate. Preferably the carrier polymer is liquid at room temperature, melting at less than about 30° C. Its member average molecular weight is in the range of 800–5000. Typically these polycarbonamides are made from an aliphatic diamine having alkyl substitution at both nitrogen atoms and from an aliphatic dicarboxylic acid. The diamine may contain minor amounts of single substituted or unsubstituted nitrogens. Preferably the alkyl substitution groups of the diamine contain between 2–12 carbon atoms. Between 26–6 carbons are especially preferred. The diamine preferably has between 2–12 carbon atoms in its alkylene group. The dicarboxylic acid preferably has between 4–12 carbon atoms in its alkylene group. The carrier polymer may be end capped with, for example, stearic acid. These polymers and methods for making them are disclosed in U.S. Pat. No. 3,900,676, the disclosure of which is hereby incorporated by reference. Some suitable N,N'-dialkyl polycarbonamides include those prepared by reacting N,N'-diethylhexamethylene diamine or N,N'-dibutylhexamethylene diamine with adipic, azelaic or dodecanedioic acid. Poly(N,N'-dibutylhexamethylene dodecamide) and poly(N,N'-diethylhexamethylene dodecamide) are preferred. The especially preferred polymeric carrier is poly(N,N'-dibutylhexamethylene dodecamide) which is a liquid at room temperature (25° C.) and has a number average molecular weight of approximately 2400. The latter polymer is end capped with approximately 15 weight percent stearic acid.

The pigment concentrates of this invention can be prepared by combining from 1–60% by weight dry pigment with from 40–99 weight percent of the liquid carrier polymer and mixing thoroughly such as in a conventional three roll mill. The resulting concentrates have a typical viscosity between 400 cP and 40000 cP as measured at 120° C. on a Brookfield Thermsel viscometer (model LVT DV II). Conventional amounts of lubricants and surfactants commonly used as dispersion aids can also be added to ensure even greater uniformity of dispersion. The full range of colored pigments and dyes, including both inorganic and organic types and their combinations, may be used to form these pigment concentrates.

These pigment concentrates are particularly useful in coloring nylon 6,6 fibers which are more crystalline than the other most common polyamide, nylon 6, and therefore tend to be more difficult to spin. Nonetheless the concentrates can be used to color both nylon 6 and other polyamides and copolyamides in addition to nylon 6,6 and copolyamides thereof. Particularly good results have been shown in coloring stain-resistant yarns of the type disclosed in the Anton et al. patent referred to earlier, where the polyamide is a nylon 6,6 copolymer containing minor amounts of a cationic dye additive such as 5-sulfoisophthalic acid.

Polyamide fibers colored with these pigment concentrates can be used in the full range of fiber end-uses, including without limitation, carpeting, upholstery, textile fabrics, and industrial applications. Polyamide resins colored with these pigment compositions can also be used in non-fiber applications, such as in the manufacture of blow-molded or injection-molded products or in the manufacture of other types of formed articles.

TEST METHODS

Relative Viscosity (RV) is the formic acid relative viscosity measured as described at col. 2, lines 42–51, in Jennings, U.S. Pat. No. 4,702,875, the disclosure of which is hereby incorporated by reference.

Amine and Carboxyl Ends are determined by the methods described on pages 293 and 294 in Volume 17 of the "Encyclopedia of Industrial Chemical Analysis" published by John Wiley & Sons (1973).

Modification Ratio (MR) is defined and measured as in Bankar et al., U.S. Pat. No. 4,492,731, the disclosure of which is hereby incorporated by reference.

Draw Tension is the tension on the yarn in the draw zone as it is being drawn to a predetermined degree. It is measured using a hand-held tensiometer, Model TR 2000 from Tensitron, Inc., Harvard, Mass., at a location approximately 1.5" (3.8 cm) above the second draw pin shown in FIG. 1.

Isothermal Crystallization Rates (half-times) were measured by Differential Scanning Calorimetry (DSC) using standard software. A Perkin-Elmer DSC-7 with an attached cooler was used. Fiber samples weighing approximately 7–8 mg were dried in a 100° C. vacuum oven over night and then placed into the DSC cell which was continuously purged with nitrogen at a rate of 40 ml/min. Samples were heated to 200° C. very rapidly, then heated at a controlled rate of 50° C./minute to 290° C. held for five minutes, cooled at 50° C./minute to a temperature below the sample's melting point and then held at that temperature (hereafter sometimes referred to as the "isothermal temperature") for 15–30 minutes until the crystallization was completed.

EXAMPLES

The following examples are offered for the purposes of illustrating the invention and are not intended to be limiting. Percentages are by weight except where otherwise indicated. The fiber-forming polyamide used in the controls and in the examples is the copolyamide described in the Anton et al. patent mentioned earlier. Pigment concentrates used in the controls are the type described in the Anton et al. patent whereas pigment concentrates used in the examples are those of this invention. The pigments used here are known to cause processing problems (spinning breaks) when spun into polyamide fibers using pigment concentrates of the prior art. Draw tension and isothermal crystallization half-time are measures of the processability of the pigmented polyamide fibers. Generally, for a given pigment and pigment level in yarn, the lower the draw tension and the longer the isothermal crystallization half-time, the better the spinning performance of the fibers (fewer breaks).

Control 1

A nylon 66 copolymer containing 2% by weight of sodium 5-sulfoisophthalate, randomly distributed through the polymer chain, was prepared in an autoclave by a conventional batch condensation polymerization technique with salts of hexamethylene diamine/adipic acid and hexamethylene diamine/-sodium 5-sulfo-methylisophthalate. The polymer was pelletized into flake after the polymerization, and this flake was then further polymerized in a solid phase polymerizer with the use of inert gas under controlled temperature and humidity conditions. Nominal formic acid RV=35, amine ends=54 eq./1,000 kg and carboxyl ends=95 eq./1,000 kg.

The flake was fed to a twin-screw melter. Also added to the screw through an additive feeder was a solid pellet color concentrate which contained 20% Phthalocyanine Green pigment (PG-7), 50% nylon 6, 19.85% of nylon 6/66/610 multipolymer (46/34/20 wt. % respectively) and 10.15% lubricant. Nylon 66 fibers containing this green pigment are particularly difficult to spin. Feed rates of the polymer and color concentrate were adjusted so that the final concentration of the pigment in BCF yarn was 0.3 percent.

The mixture or blend of color concentrate with nylon 66 copolymer was then spun at a rate of 69.2 pounds/-hour (31.4 kg/hour) through a 136 hole 2.3 MR trilobal spinneret. Cooling air (about 10° C.) was blown past the hot filaments at a flow rate of about 250 cubic ft./minute (7.1 cubic meters/min.). The 68 filaments in the yarn bundle were pulled from the spinneret and through the quench zone by means of a puller or feed roll, rotating at 887 yards per minute (811 meters/minute). After quenching, the filaments were treated with spin-draw finish. Next, the filaments were drawn over a pair of draw pins by a pair of heated (185° C.) draw rolls, rotating at 2355 ypm (2153 meters/min.). The yarn filaments were heated and bulked as described in Breen and Lauterbach, U.S. Pat. No. 3,186,155. The bulking air temperature was 220° C. The final product was a 1225 denier (1338 dtex), 18 denier (19.7 dtex) per filament yarn.

This process was inoperable due to the large number of broken filaments. As a route to quantify the ease of spinning, the process was characterized by measuring the draw tension and isothermal crystallization half-time of the yarn. Low draw tension (e.g. below 1600 grams) and a long crystallization half-time generally indicates a good spinning process (minimum number of breaks). However, the characteristics shown in Table I confirm poor spinning performance.

EXAMPLE 1

The nylon copolymer, spinning equipment and spinning conditions were the same as in Control 1 above, except a color concentrate of this invention was used. For this example, the color concentrate was in the liquid phase and was prepared by mixing 20% by weight of PG-7 pigments with poly(N,N'-dibutylhexamethylene dodecamide) on a conventional three-roll mill. An appropriate amount of the concentrate to give 0.3 percent pigment in yarn was injected into the nylon 66 copolymer melt just before the spinneret and mixed with the molten nylon 66 copolymer via a series of in-line static mixers (Koch and Kenics).

The spinning process was now acceptable at the 0.3% pigment in yarn level. The draw tension and the crystallization half-time are shown in Table I.

Control 2

For this control, a solid color concentrate was made with 13.18% of Dark Plum pigment (a combination of Channel Black, Phthalocyanine blue, and Perylene Red pigments) in 67.05% nylon 6, 18.58% nylon 6/66/610 multipolymer (as in Control 1) and 1.19% other additives. A 128-hole hollow filament spinneret was used. The spinning equipment was the same as in Control 1 and the spinning conditions, while similar, were slightly modified for hollow filament spinning: feed roll speed=869 ypm (795 meters/min.), draw roll temperature=194° C. and draw roll speed=2389 ypm (2185 meters/min.).

The spinning process was borderline to acceptable with some broken filaments. The draw tension and the crystallization half-time are shown in Table I.

EXAMPLE 2

All spinning equipment and the process conditions were the same as Control 2. The injection process was similar to Example 1 and the color concentrate contained 15% dark plum pigment in poly(N,N'-dibutylhexamethylene dodecamide) carrier. The ratios of constituent pigments were the same as in Control 2.

The spinning process was significantly better (fewer breaks) than in Control 2. The draw tension and the crystallization half-time shown in Table I confirm good spinning performance.

TABLE I

| | CARRIER | PIGMENT | % PIGMENT IN YARN | DRAW TENSION | CRYSTALLIZATION HALF-TIME |
|---|---|---|---|---|---|
| Control 1 | A | PG-7 | 0.30 | 1600 gms | 0.556 Min.(*) |
| Example 1 | B | PG-7 | 0.30 | 1500 gms | 0.699 Min.(*) |
| Control 2 | A | Dark Plum | 0.37 | 1450 gms | 1.07 Min.(**) |
| Example 2 | B | Dark | 0.30 | 1200 gms | 1.33 Min.(**) |

TABLE I-continued

| CARRIER | PIGMENT | % PIGMENT IN YARN | DRAW TENSION | CRYSTALLIZATION HALF-TIME |
|---|---|---|---|---|
| | Plum | | | |

A = nylon 6 and nylon 6/66/610 multipolymer mixture
B = poly(N,N'-dibutylhexamethylene dodecamide)
(*)Isothermal recrystallization done at 236° C.
(**)Isothermal recrystallization done at 240° C.

I claim:

1. A method for improving spinning performance in a process for preparing drawn pigmented polyamide filaments comprising the steps of:

a) adding to a molten fiber-forming polyamide a liquid pigment concentrate comprising from 1%–60%, based on total weight of concentrate, pigment dispersed in a polymer matrix of from 40%–99%, based on total weight of concentrate, of an N,N'-dialkyl polycarbonamide having a melting point less than about 100° C. and a number average molecular weight between 800–5000;

b) mixing said liquid pigment concentrate with said molten fiber-forming polyamide to produce a uniform blend;

c) spinning said blend into filaments; and d) drawing said filaments.

2. The method of claim 1 wherein the N,N'-dialkyl polycarbonamide is selected from the group consisting of poly(N,N'-dibutylhexamethylene dodecamide and poly(N,N'diethylhexamethylene dodecamide.

3. The method of claim 3 wherein the N,N'-dialkyl polycarbonamide is poly(N,N'-dibutylhexamethylene dodecamide.

* * * * *